US008886504B2

(12) United States Patent
Standifird et al.

(10) Patent No.: US 8,886,504 B2
(45) Date of Patent: Nov. 11, 2014

(54) SYSTEMS AND METHODS FOR MODELING AND TRIGGERING SAFETY BARRIERS

(75) Inventors: William Bradley Standifird, Surrey (GB); William Paul Fowler, IV, Richmond, TX (US); Edgar Eli Diaz-Aguirre, Richmond, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 13/883,930

(22) PCT Filed: Jan. 30, 2012

(86) PCT No.: PCT/US2012/023111

§ 371 (c)(1), (2), (4) Date: May 7, 2013

(87) PCT Pub. No.: WO2013/115766

PCT Pub. Date: Aug. 8, 2013

(65) Prior Publication Data

US 2014/0041860 A1 Feb. 13, 2014

(51) Int. Cl.

| | |
|---|---|
| ***G06G 7/48*** | (2006.01) |
| ***E21B 41/00*** | (2006.01) |
| ***E21B 33/06*** | (2006.01) |
| ***E21B 44/00*** | (2006.01) |

(52) U.S. Cl.

CPC ..... *E21B 41/0092* (2013.01); *E21B 33/06* (2013.01); *E21B 44/00* (2013.01)

USPC ..... 703/10; 166/85.4

(58) Field of Classification Search

CPC ..... E21B 43/24; E21B 33/035; E21B 19/00; E21B 47/00; E21B 7/00; E21B 19/20; E21B 33/06; E21B 15/00; E21B 41/00; E21B 21/00; E21B 34/06; E21B 10/00; E21B 7/14; E21B 7/04; E21B 7/20; E21B 7/08; E21B 36/00; E21B 36/04; E21B 43/16; E21B 47/06; G06F 17/50; G06F 17/10; G06F 19/00; B63B 35/44; F16D 9/06; B05D 1/36; F16H 47/10; H05B 3/06; H05B 6/64; H01C 17/02; E21C 37/16

USPC ..... 703/10; 166/373, 358, 85.4; 702/6; 175/61

See application file for complete search history.

(56) References Cited

U.S. PATENT DOCUMENTS 4,691,384 A 9/1987 Jobe
5,662,170 A * 9/1997 Donovan et al. ..... 166/358

(Continued)

OTHER PUBLICATIONS

International Search Report and Writtent Opinion issued Feb. 14, 2013 in International Patent Application No. PCT/US2012/023111, filed Jan. 30, 2012.

*Primary Examiner* — Kandasamy Thangavelu
(74) *Attorney, Agent, or Firm* — Conley Rose, P.C.

(57) ABSTRACT

Modeling and triggering safety barriers. At least some of the illustrative embodiments are a non-transitory machine-readable storage medium includes executable instructions that, when executed, cause one or more processors to model, using one or more models, safety barriers in one or more drilling rigs based on drilling rig safety barrier data. The processors are further caused to identify, based on the one or more models, a first impending invalidation of a first safety barrier. The processors are further caused to initialize, triggered solely by the instructions, a second safety barrier based on the impending invalidation.

20 Claims, 4 Drawing Sheets

(56) References Cited

U.S. PATENT DOCUMENTS

| | | | | |
|---|---|---|---|---|
| 2003/0079912 | A1 | 5/2003 | Leuchtenberg | |
| 2005/0115741 | A1* | 6/2005 | Terry et al. | 175/61 |
| 2005/0194188 | A1* | 9/2005 | Glaser et al. | 175/61 |
| 2005/0222772 | A1* | 10/2005 | Koederitz et al. | 702/6 |
| 2007/0062692 | A1 | 3/2007 | Estevez et al. | |
| 2009/0225630 | A1 | 9/2009 | Zheng et al. | |
| 2011/0214882 | A1* | 9/2011 | Santos | 166/373 |
| 2012/0067563 | A1* | 3/2012 | Jellison | 166/85.4 |

* cited by examiner

SYSTEMS AND METHODS FOR MODELING AND TRIGGERING SAFETY BARRIERS

BACKGROUND

A well is a pathway through subsurface formations to a target reservoir potentially containing hydrocarbons. If a commercial quantity of hydrocarbons is discovered, a casing is set and completion equipment is installed to safely control the flow of hydrocarbons to the surface while preventing undesired flow through other paths for the life of the well.

Devising drilling rig safety protocol that reduces the potential for injury and reduces uncontrolled well flow is challenging. Not only are proper actions needed, but proper communication, recording, and reporting are needed as well. Moreover, the challenge increases with the addition of multiple rigs and multiple levels of hierarchy needing a unified response to impending safety barrier violations.

BRIEF DESCRIPTION OF THE DRAWINGS

For a more complete understanding of the present disclosure, reference is now made to the accompanying drawings and detailed description, wherein like reference numerals represent like parts.

NOTATION AND NOMENCLATURE

Figure 1:
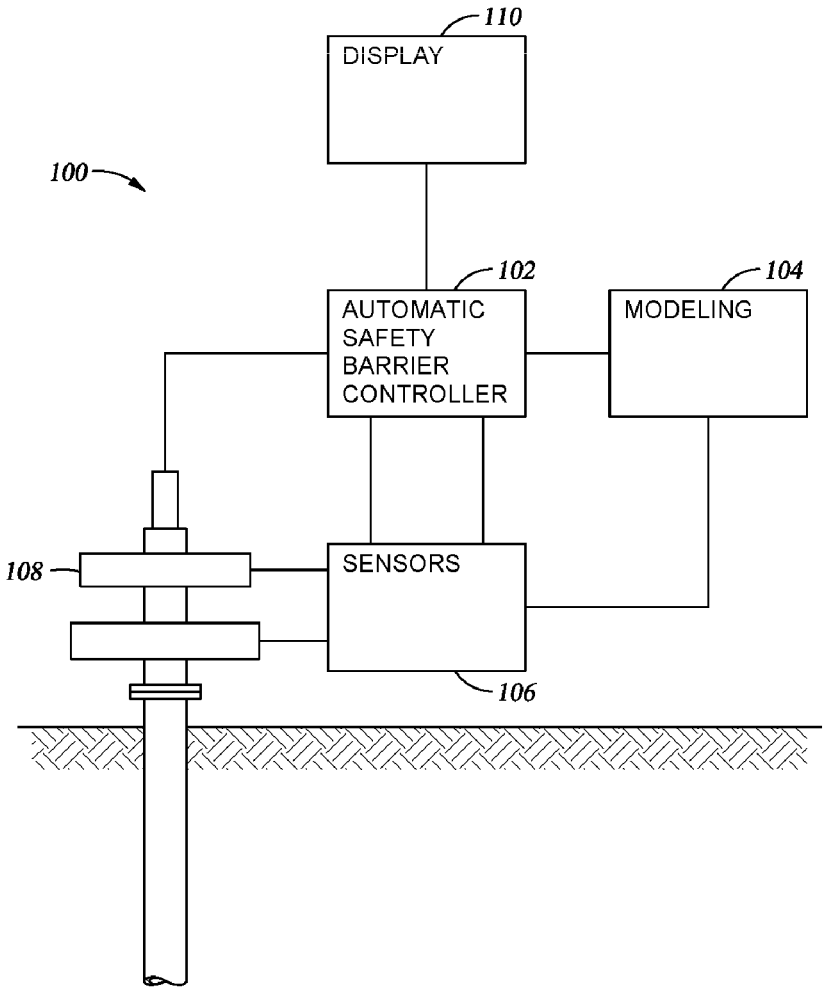
FIG. 1 illustrates a logical view of a system for modeling and triggering safety barriers in accordance with at least some illustrative embodiments.

Certain terms are used throughout the following claims and description to refer to particular components. As one skilled in the art will appreciate, different entities may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ."

"Safety barrier" shall mean a physical object or a procedure that contributes to drilling rig system reliability if the safety barrier is properly deployed.

In the case of a safety barrier in the form of a procedure, a "validated" safety barrier shall mean confirmation that the procedure has been followed. In the case of a safety barrier in the form of a physical object, a "validated" safety barrier shall mean confirmation that a parameter associated with the safety barrier is within predetermined range. Confirmation may take the form of post-installation test or reading, or confirmation may take the form of observations recorded during installation or post-installation.

"Validation" shall mean the act of confirming that a safety barrier is validated.

In the case of a safety barrier in the form of a procedure, an "invalidated" safety barrier shall mean a violation of a procedure. In the case of a safety barrier in the form of a physical object, an "invalidated" safety barrier shall mean a parameter associated with the safety barrier is not within predetermined range.

A safety barrier has an "unknown" status if validation cannot be confirmed.

"Initializing" a safety barrier shall mean triggering an installation process for a safety barrier or a validation process for the safety barrier if the safety barrier is already installed.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims, unless otherwise specified. In addition, one having ordinary skill in the art will understand that the following description has broad application, and the discussion of any embodiment is meant only to be exemplary of that embodiment, and not intended to intimate that the scope of the disclosure, including the claims, is limited to that embodiment.

Various embodiments are directed to operation of safety barriers. More particularly, at least some embodiments are directed to systems and methods for modeling safety barriers, and in some cases triggering safety barriers based on the models. A safety barrier is a physical object or a procedure that, if properly deployed, contributes to total drilling rig system reliability by reducing or preventing injury, and/or reducing or prevented unintended fluid flow. A "validated" safety barrier is a safety barrier for which proper deployment has been confirmed through a post-installation test or through observations recorded during installation or post-installation. Such validation provides a high degree of assurance that the drilling rig is safe and fluid is contained. One way to evidence validation is with a drilling rig parameter that is within its intended range. "Invalidation" of a safety barrier involves operating with a drilling rig parameter outside an intended range, or failing to follow a procedure designed for the safety of the drilling rig and/or containment of fluid. One way to evidence invalidation is by way a drilling rig parameter that is not within its intended range. Thus, a safety barrier is not necessarily a physical barrier but may also be an operational characteristic or method.

A system of multiple safety barriers may be used to achieve a high level of reliability in avoiding uncontrolled fluid flow during well construction, operation, and abandonment. The well reliability that is achieved is a function of the combined reliabilities of each individual safety barrier. The number and types of safety barriers used varies with the specific operation. In at least one embodiment, if an operation is performed with fewer than two safety barriers in place, then risk becomes critical. There are several illustrative safety barriers that may be associated with a drilling rig and drilling operation. Some safety barriers may have associated parameters, where such parameters may be measurements taken by sensors or inspection to assess the deployment of the safety barrier. A non-exhaustive list of safety barriers comprises the riser safety barrier, casing safety barrier, wellhead safety barrier, surface equipment safety barrier, blowout preventer safety barrier, cement safety barrier, and mud column safety barrier. Each safety barrier is associated with parameters. Each of the illustrative safety barriers is discussed in turn, beginning with the riser safety barrier.

The riser is a large-diameter pipe for a subsea well connecting a wellhead with a rig. The main tubular section of the riser brings mud to the surface. As such, a riser may be hundreds or thousands of feet in length in order to traverse the depth of the sea. Other sections of the riser are used to house power lines and control lines for the blowout preventer ("BOP") on or near the sea floor. The riser safety barrier ensures that riser parameters stay within tolerable limits.

One parameter associated with the riser safety barrier may be the minimum and maximum allowable tension for safe operation of the riser. For drill pipe rigs, the minimum top tension provides sufficient tension at a connector between the lower marine riser package ("LMRP") and blowout preventer ("BOP") stack such that the lower marine riser package can be lifted off the BOP stack in an emergency disconnect situation. The minimum top tension may also prevent buckling at the bottom of the riser. Maximum top tension may be governed by drilling recoil. Another illustrative parameter associated with the riser safety barrier is the maximum weather conditions under which the riser can be run, retrieved, or hung-off. Yet another illustrative parameter associated with the riser safety barrier is the riser hang-off values at various water depths. The riser hang-off system provides structural support between tubes, such as the main tube and outer tube, and the riser hang-off system includes seals between tubes. Another illustrative parameter associated with the riser safety barrier may be riser fatigue, especially if water currents are expected. In some cases, risers are equipped with vortex-induced vibration ("VIV") suppression devices over the depth interval of the highest currents to achieve an acceptable riser fatigue value.

Another parameter associated with the riser safety barrier may be operating limits for tripping pipe or pipe rotation. Ensuring such limits begins by establishing the maximum allowable inclination at the wellhead. After the riser and BOP stack are run and latched to the wellhead, BOP inclination data and riser sensor data from a lower flex joint of the riser are monitored to ensure that the lower flex joint angles do not exceed established limits.

Another illustrative parameter associated with the riser safety barrier is subsea water currents. Subsea water currents can affect the shape of the riser and cause increased wear. The use of loop current tracking services or acoustic Doppler current characteristics may be used for measuring water surface currents and current characteristics versus depth at a specific location.

Yet another illustrative parameter associated with the riser safety barrier is abnormal wear of the riser components. During drilling operations, a ditch magnet is sometimes placed in the mud return flow path to collect steel particles. Daily weighing of the collected steel particles provides a way to detect abnormal wear in the riser. Additionally, periodic inspections of the riser system components may be implemented to check for internal wear.

Other illustrative parameters associated with the riser safety barrier are related to gas expansion. The solubility of gas in formation fluids and drilling mud increases with the pressure of the fluid, which pressure is affected by the type of fluid system used. Synthetic-base mud ("SBM") and oil-base mud ("OBM") systems have higher gas solubility than water-base mud. In deepwater drilling and completion operations, detection of gas influx into the wellbore that goes into solution can be masked. The gas influx may only become apparent when the gas starts breaking out of solution above the subsea BOP inside the riser, thus causing an increase in return flow rate or pit gain. To prevent expanding gas from being vented onto the rig floor, a diverter system and associated overboard vent lines provide a way to safely vent expelled mud and gas through the downwind vent lines away from the rig. As such, parameters of the riser safety barrier may further include temperature, pressure, and rate of flow in the riser, diverter system, and vents.

Next consider safety barriers associated with the casing. A casing is a tubular member installed and cemented in the well. The casing provides the foundation for a deepwater well, and the casing is designed to withstand two primary loads: bearing load and bending load. Many factors account for the amount of bearing load and bending load the casing can withstand. One such factor is installation method of the pipe. One method of installing casing is by jetting. Other structural installation methods include drilling, grouting, or driving using a subsea hammer. Jetting causes the greatest degradation in bearing capacity because the jetted casing pipe initially supports its own weight. After the first riser-less casing string is cemented to the mud line and the cement has set, the bearing load for the remainder of the well, including all casings and the BOP, is supported by the combined capacity of the two casing strings. Bearing capacity is also dependent on soil strength and the disturbance to the soil as the conductor is jetted into place. The amount of disturbance depends on the rate of jetting (pumping) and time allowed for the soil to recover from jetting. Thus, one illustrative parameter of the casing safety barrier may include bearing load and bending load.

Another parameter associated with the casing safety barrier may be buckling. Buckling can be caused by thermal effects and mud weight changes, and buckling may be particularly severe when the casing passes into an enlarged hole size. As such, other illustrative parameters of the casing safety barrier may include temperature and mud weight.

Yet another illustrative parameter of the casing safety barrier is connection wear. Metal-to-metal seals for connections are prone to wear especially for flush or semi-flush connections, which usually have a metal-to-metal seal on a formed pin that has a reduced inner diameter. It may be difficult to determine when connection wear has actually occurred; for this reason, in some embodiments the connection wear may be modeled, and the state of the connection wear as a parameter of a safety barrier may be determined based on the model.

Turning to wellhead equipment, the inner surfaces of subsea wellheads are protected by corrosion-preventative fluids and coatings such as zinc, manganese phosphate, or a fluoropolymer. High-pressure seal preparations are overlaid with alloys for additional corrosion protection. Corrosion effects can also be mitigated through the quality of paint used. As such, parameters associated with the wellhead equipment safety barrier may include amount of corrosion, thickness of the corrosion-preventative fluids, and effectiveness of the seals. In some cases, the state of the protective coatings may be physically inspected. In other situations though, particularly situations where the drilling operations are ongoing, it may be difficult to determine when the state of the protective coatings has degraded. For this reason, in some embodiments the state of the protective coatings may be modeled, and the effect of degradation on wellhead equipment may be determined based on the model.

Moving on to surface equipment, various types of surface equipment need periodic inspection. Some safety barrier parameters associated with the surface equipment safety barrier involve testing the following equipment: back pressure control valves, fluid dump valves, fluid turbine meters, isolation valves, choke manifold valves, test ball valves, surface test trees, surface safety valves, flow lines, choke manifolds, surface separation equipment, fluid lines, flare lines, production lines, vent lines, burner nozzles and air compressors. Additionally, the following equipment can be inspected for proper connections, fit, and cleanliness: flanges, instrument supply air, equipment piping, sight glasses, pipe restraining systems, hoses, and propane bottles. Fluid levels may also be used as parameters associated with the surface equipment safety barrier.

Next, the BOP is a system of hardware installed at the mud line above the subsea wellhead that is capable of sealing the open wellbore and sealing tubulars in the wellbore. The BOP includes high pressure choke lines, kill lines, choke valves, and kill valves. The subsea BOP incorporates multiple elements designed to close around different sizes of drill pipe, casing, or tubing used in well construction. The BOP main body is subjected to bending loads from the riser. As such, some parameters associated with the BOP safety barrier may include pressure, loads, and effectiveness of seals and valves.

Turning to the cement safety barrier, plugs located in the open hole or inside the casing/liner prevent fluid flow between zones or up the wellbore. The plugs may be formed with cement slurry plus additives, and the cement slurry density may be a parameter associated with the cement safety barrier.

Finally, a mud column extends from the bottom of the borehole, and the mud column exerts hydrostatic pressure on the formation. Failure to maintain the mud column height may cause a pressure underbalance and allow the formation to flow. The density of the fluid and the temperature profile of the well may be monitored to maintain the overbalance. Thus, some parameters associated with the mud column safety barrier are: flow in, flow out, mud density in, mud density out, rotary speed, running speed, and total gas.

The various safety barriers, and related parameters, discussed to this point are merely illustrative. Many other safety barriers may be implemented as part of a drilling operation, whether subsea or land-based. Regardless of the precise safety barriers implemented, many safety barriers associated with a drilling rig may be monitored at one time. Moreover, the overall system may include monitoring safety barriers implemented across multiple drilling rings. More specifically then, in accordance with at least some embodiments, various safety barriers are monitored. Should a safety barrier be in danger of impending invalidation, the various systems described herein may automatically initialize another safety barrier. Initialization of a safety barrier may comprise, for example, triggering an installation process for a safety barrier, or trigging a validation process for the safety barrier if the safety barrier is already installed.

FIG. 1 illustrates a logical overview of a system 100 for modeling and triggering automatic initialization of safety barriers. So as not to unduly complicate the figure, a single BOP 108 safety barrier is illustratively shown. However, many safety barriers on the same or different rigs are possible. The illustrative BOP 108 may be coupled to sensors 106 which measure the various parameters of the safety barriers. In some embodiments, the sensors 106 may automatically measure the parameters, but in other cases measuring may include some manual components. For example, a mud column sensor 106 that measures "flow in" for the mud column safety barrier may continuously or periodically detect the flow rate in the mud column and report the measured rate without human input. However, a parameter such as "all flanges connected and secure" for the surface equipment safety barrier may utilize human inspection input in the form of a report, entry in a database, or other data structure.

The illustrative sensors 106 may be coupled to an automatic safety barrier controller 102 and modeling logic 104. In at least one embodiment, the controller 102 may be embodied as a single computer system or multiple computer systems, where each computer system may comprise a processor and memory. The processor of the controller 102 may execute instructions that read parameters of safety barriers (such as by reading sensors 106). Moreover, for parameters that cannot be directly read or determined, the controller 102 may model various safety barriers using parameters measured by the sensors 106 as input data. In other embodiments, the controller 102 may be coupled to modeling logic 104 tasked with executing instructions that model safety barriers and/or parameters associated with safety barriers.

Consider, as an example of a modeled safety barrier, the casing safety barrier, and more particularly the casing thickness parameter and casing temperature parameter. The casing thickness parameter may be a constant that is provided by an operator or selected based on type of casing used. The casing thickness may be associated with a maximum threshold temperature. That is, different casing thicknesses may have different maximum threshold temperatures. Going above this temperature may increase the likelihood of the casing buckling. Casing temperature may be a parameter that is measured automatically by a sensor 106. The controller 102 may periodically or continuously compare casing temperature with the maximum threshold temperature for a particular casing thickness. The controller 102 may refer to a set of rules to identify an impending safety barrier violation. For example, if the difference between the maximum threshold temperature and the casing temperature is less than five degrees, the controller 102 may identify an impending invalidation and trigger initialization of another safety barrier. Similarly, other rules may be simultaneously implemented. For example, if the rate of temperature change of the casing temperature is greater than ten degrees per minute, the controller 102 may identify an impending invalidation and trigger initialization of another safety barrier. Similarly, other combinations of rules, parameters, and tolerances may be used.

In accordance with at least some embodiments, the controller 102 may be coupled to one or more displays 110. The displays 110 may implement a graphical user interface that can be manipulated using a pointing device, keyboard, and other inputs in various embodiments. Thus, by way of the displays the controller 102 may show the state of one or more safety barriers in graphical or numerical form. Moreover, for safety barriers validated by way of human inspection, the displays 110 may be the mechanism by which validation information is provided to the controller 102. Further still, when parameters of a safety barrier, or the safety barrier itself, is modeled by the controller 102 and/or the modeling unit 104, the displays 110 may be used to accept parameters used in the modeling.

The status or state of a safety barrier may take many forms. For example, a safety barrier may be validated or invalidated. Further, in some cases the state of a safety barrier may not be known, and thus may have an unknown status. In some cases, when the state of a predetermined number of safety barriers is invalidated or of unknown status, the controller 102 may initialize the validation of an additional or further safety barrier. However, in other cases, when the state of a predetermined number of safety barriers is invalidated or of unknown status, the controller 102 may initialize a failsafe procedure rather than a safety barrier. A failsafe procedure may involve change the operational state of one or more pieces of equipment. For example, a failsafe procedure may comprise activating the BOP to isolate the wellbore from the surface equipment. In addition to or in place of changing the operational state of one or more pieces of equipment, a failsafe procedure may involve a process, such as an evacuation procedure.

Figure 2:
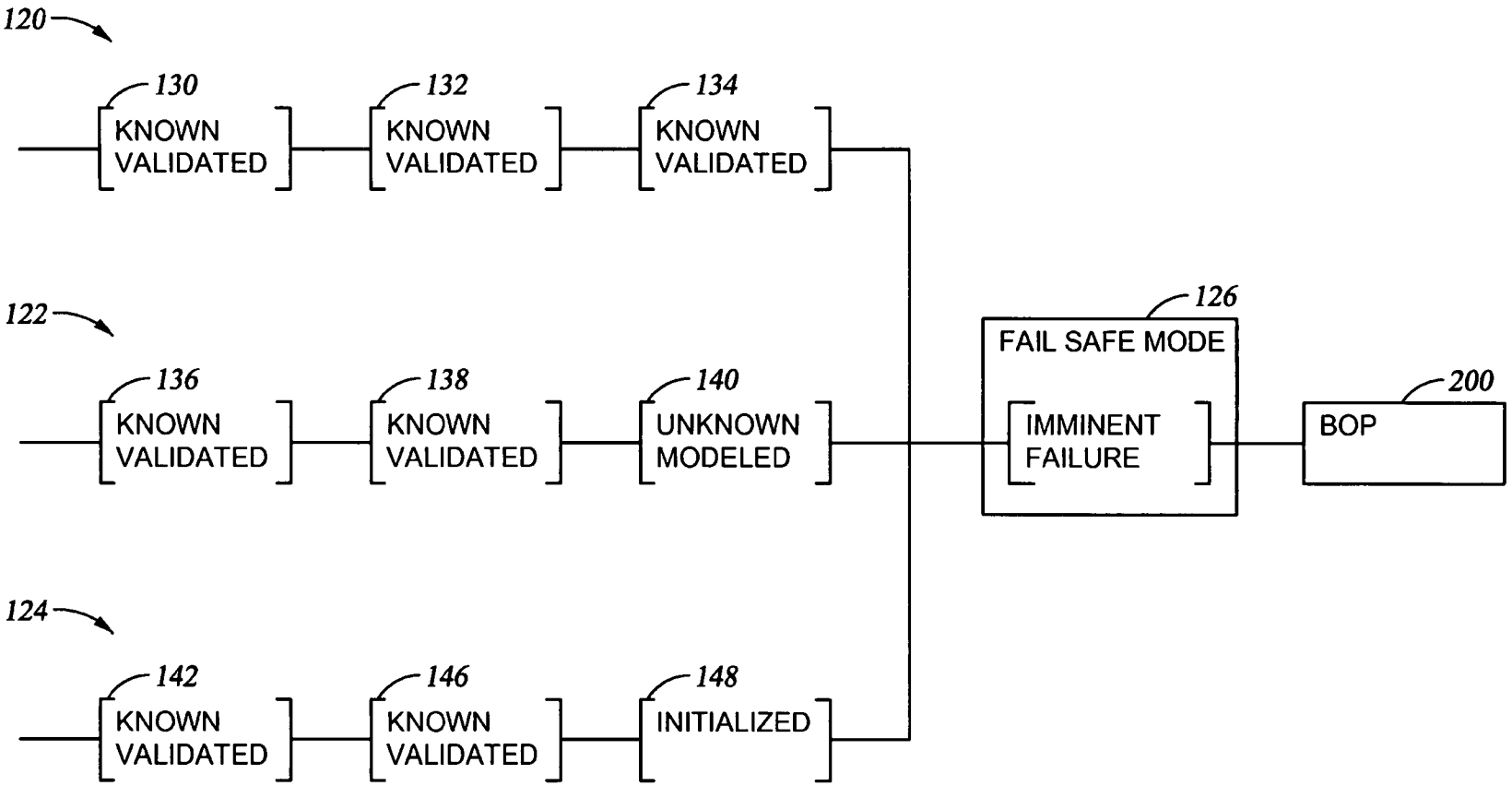
FIG. 2 illustrates a logical view of failsafe conditions for triggering failsafe procedures in accordance with at least some illustrative embodiments.

FIG. 2 illustrates, in ladder-logic form, an example set of logic associated with a failsafe mode. More particularly, FIG.

2 illustrates logic associated with activation of a failsafe in the form of activating a BOP to isolate a wellbore. Again, the failsafe mode in the form of activation of a BOP is merely illustrative, and other types of failsafe modes (with their respective logic) are also contemplated. In FIG. 2, a non-asserted input to the BOP 200 will cause the BOP to activate. As illustrated, there are three rungs or combinations of logic, any one of which alone may prevent the failsafe mode from triggering by asserting the input to the BOP. That is, rung or combination logic 120, if asserted, may prevent the failsafe mode from triggering independent of the state of the other rungs or combinations. Likewise, rung or combination logic 122, if asserted, may prevent the failsafe mode from triggering. Rung or combination logic 124, if asserted, may prevent the failsafe mode from triggering. The three combinations are logically connected (a logical OR operation), and coupled to the logic 126. Each bracket in FIG. 2 represents a safety barrier, with the state of the safety barrier delineated in the bracket. For example, bracket 130 in combination 120 illustrates a known and validated safety barrier. A safety barrier may be known to be validated and known to be invalidated. The validation status may also be unknown, and thus the state of the safety barrier may be modeled. For example, bracket 140 in combination 122 illustrates the status of an unknown safety barrier that may be modeled. The modeling may suggest or recommend that the status of the safety barrier be changed to validated or invalidated. However, in other embodiments modeling may occur on known and validated safety barriers to identify impending invalidations. In other embodiments, modeling ceases on validated safety barriers to conserve resources. Each of the illustrative combinations is discussed in turn, starting with combination 120.

Rung or combination 120 may be viewed as a logical AND operation. That is, if safety barrier 130 is known and validated, safety barrier 132 is known and validated, and safety barrier 134 is known and validated, the BOP is not activated. In other words, combination 120 may represent the rule: "if the status of three safety barriers is known to be validated, prevent the BOP from activating."

Rung or combination 122 may also be viewed as a logical AND operation. However, in the illustrative case of combination 122 while the state of safety barrier 136 and 138 are known, the state of safety barrier 140 is not known. That is, bracket 140 in combination 122 illustrates the status of an unknown safety barrier. In accordance with at least some embodiments, the state of an unknown safety barrier is modeled, and if the model indicates the safety barrier should still be in a validated state, then the logic of combination 122 is satisfied and the illustrative BOP is not activated. Stated otherwise, if the model indicates that enough parameters are within tolerance levels, the model may recommend that the controller 102 flag the safety barrier as validated. In words then, combination 122 may represent the rule: "if the status of two safety barriers are known to be validated, and the modeled status of one unknown safety barrier is validated, prevent the BOP from activating."

Rung or combination 124, like the previous combinations, may be viewed as a logical AND operation. However, in this case not only can the state of known and validated be considered an asserted state, but also a state of "initialized" is an asserted state. In the illustrative case of combination 124 while the state of safety barrier 142 and 144 are known and validated, the state of safety barrier 146 is "initialized." That is, bracket 146 in combination 124 illustrates the status of a newly initialized safety barrier. A newly initialized safety barrier is in the process of being validated or installed. In this illustrative case, with safety barriers 142 and 144 validated, and safety barrier 146 "initialized", the BOP is not activated. In other words, combination 124 may represent the rule: "if the status of two safety barriers is known to be validated, and one safety barrier has been recently initialized, prevent the BOP from activating."

Logic 126 represents a direct activation of the illustrative failsafe BOP. That is, logic 126 may override assertions from rung or combination logics 120, 122, and 124, and logic 126 may cause the input to the BOP to be non-asserted (triggered in this case) if failsafe conditions are present. Stated in words, logic 126 may represent the rule: "if any failsafe conditions are present, activate the BOP." Such immediate failsafe conditions may include all safety barriers failed, all safety barriers unknown, well stability compromised, human activation of alarm, and similar conditions.

Consider a policy comprising a condition that three safety barriers should be validated at all times (e.g. any three of the riser, casing, wellhead, surface equipment, BOP, cement, and mud column safety barriers). As such, four safety barriers may be unknown. When three safety barriers are known to be validated (e.g. the riser, casing, and wellhead safety barriers), combination logic 120 may prevent activation of the BOP. In some embodiments, the three safety barriers are modeled continuously to identify impending invalidations. If an impending invalidation is identified in one safety barrier (e.g. the casing safety barrier), another safety barrier may be initialized (e.g. the mud column safety barrier). When two safety barriers are known to be validated (e.g. the riser and wellhead safety barriers) and one safety barrier is being initialized (e.g. the mud column safety barrier), combination logic 124 prevents activation of the BOP. One of the validations of a known and validated safety barrier (e.g. the wellhead safety barrier) may expire. As such, the status of the safety barrier turns from known and validated to unknown. A model of the safety barrier may indicate that key parameters are within accepted ranges. As such, the model may recommend that the status of the safety barrier turn from unknown back to validated. When two safety barriers are known to be validated (e.g. the riser and mud column safety barriers) and one safety barrier is within accepted ranges according to its model (e.g. the wellhead safety barrier), combination logic 122 prevents activation of the BOP.

Figure 3:
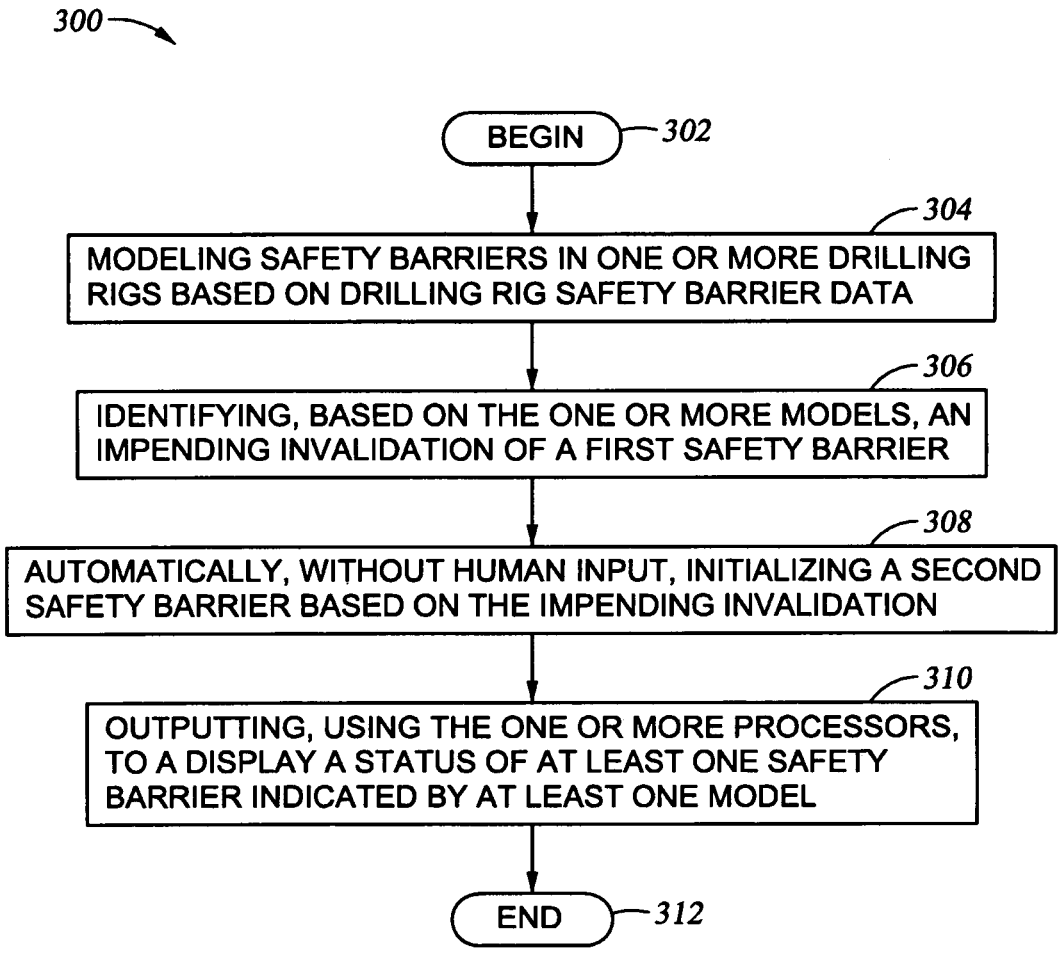
FIG. 3 illustrates a method for modeling and triggering safety barriers in accordance with at least some illustrative embodiments.

By creating logical relationships with the status of one or more safety barriers, activation of failsafe procedures may be robust and easily programmable. FIG. 3 illustrates a method of modeling and triggering safety barriers beginning at 302 and ending at 312. As described above, a safety barrier may be a riser, casing, wellhead, surface equipment, blowout preventer, cementing, or mud column. At 304, safety barriers in one or more drilling rigs may be modeled based on drilling rig safety barrier data using one or more models. For example, one or more processors and memory distributed over one or more computers on a network may receive safety barrier data from censors as inputs to implement in the models.

At 306, an impending invalidation of a first safety barrier may be identified based on the one or more models. For example, a set of rules may be used to identify when any parameters are approaching tolerance thresholds. At 308, a second safety barrier may be automatically initialized based on the impending invalidation. For example, the validation process for the safety barrier may be triggered. In at least one embodiment automatically means without human input. For example, no human confirmation, selection, or decision is needed to trigger the initialization of the second safety barrier. Rather, the impending violation is the only trigger necessary. In at least one embodiment, the impending invalidation may also trigger recording of the drilling rig safety barrier data.

For example, sensor output for a particular safety barrier may be recorded to memory for a predefined or indefinite amount of time. The recordings may be saved, output for display, or used in reports. In at least one embodiment, responsiveness of human input reacting to the impending invalidation may be tested. For example, if human input is detected responding to the impending invalidation, automatic initialization of the second safety barrier may be suspended. If no human input is detected, the speed of automatic initialization of the second safety barrier may be increased.

At 310, a status of at least one safety barrier indicated by at least one model may be output for display. Modeling data may also be transformed for output to the display in graphical or numerical form.

Should a second impending invalidation of a second safety barrier occur, a failsafe procedure may be triggered. For example, an evacuation procedure may be initialized. In at least one embodiment, a safety barrier may be prevented from being removed when three or fewer models indicate validated safety barriers. For example, four safety barriers may be validated, and two operators may independently decide to remove a different safety barrier, each operator unaware of the decision of the other. One of the operators may be prevented from removing a safety barrier to maintain at least three validated safety barriers.

From the description provided herein, those skilled in the art are readily able to combine software created as described with appropriate computer hardware to create a special purpose computer system and/or computer sub-components for carrying out the methods of the various embodiments and/or to create a computer-readable media that stores a software program to implement the method aspects of the various embodiments.

Figure 4:
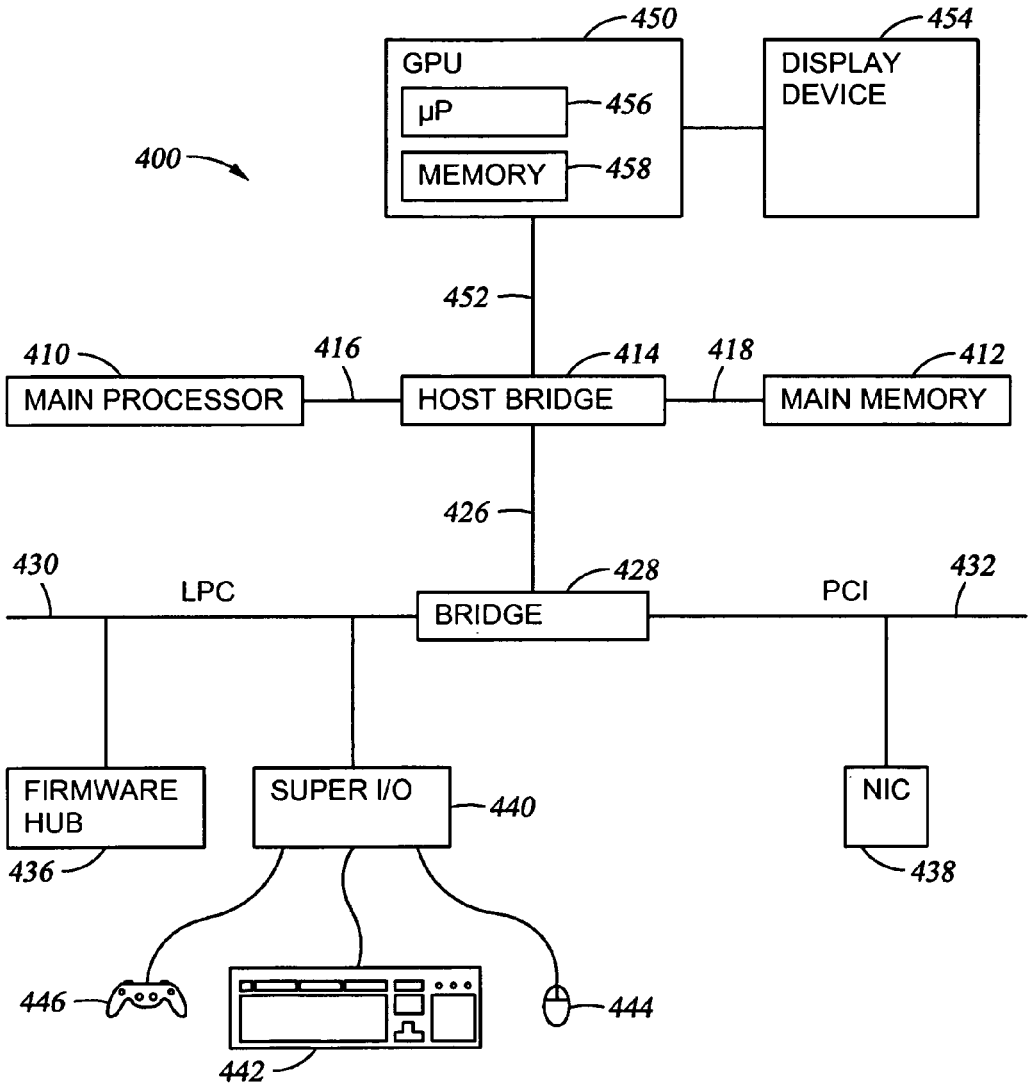
FIG. 4 illustrates a computer system and non-transitory machine-readable storage medium suitable for use with modeling and triggering safety barriers in accordance with at least some illustrative embodiments.

FIG. 4 illustrates a computer system 400 in accordance with at least some embodiments. The computer system 400 may be illustrative of controller 102, or modeling component 104. Moreover, the functionality implemented by controller 102 and/or modeling component 104 may be implemented using multiple computer systems such as computer system 400. In particular, computer system 400 comprises a main processor 410 coupled to a main memory array 412, and various other peripheral computer system components, through integrated host bridge 414. The main processor 410 may be a single processor core device, or a processor implementing multiple processor cores. Furthermore, computer system 400 may implement multiple main processors 410. The main processor 410 couples to the host bridge 414 by way of a host bus 416, or the host bridge 414 may be integrated into the main processor 410. Thus, the computer system 400 may implement other bus configurations or bus-bridges in addition to, or in place of, those shown in FIG. 4.

The main memory 412 couples to the host bridge 414 through a memory bus 418. Thus, the host bridge 414 comprises a memory control unit that controls transactions to the main memory 412 by asserting control signals for memory accesses. In other embodiments, the main processor 410 directly implements a memory control unit, and the main memory 412 may couple directly to the main processor 410. The main memory 412 functions as the working memory for the main processor 410 and comprises a memory device or array of memory devices in which programs, instructions and data are stored. The main memory 412 may comprise any suitable type of memory such as dynamic random access memory (DRAM) or any of the various types of DRAM devices such as synchronous DRAM (SDRAM), extended data output DRAM (EDODRAM), or Rambus DRAM (RDRAM). The main memory 412 is an example of a non-transitory machine-readable medium storing programs and instructions, and other examples are disk drives and flash memory devices. The instructions, when executed, cause one or more processors to perform any step described in this disclosure.

The illustrative computer system 400 also comprises a second bridge 428 that bridges the primary expansion bus 426 to various secondary expansion buses, such as a low pin count (LPC) bus 430 and peripheral components interconnect (PCI) bus 432. Various other secondary expansion buses may be supported by the bridge device 428.

Firmware hub 436 couples to the bridge device 428 by way of the LPC bus 430. The firmware hub 436 comprises read-only memory (ROM) which contains software programs executable by the main processor 410. The software programs comprise programs executed during and just after power on self test (POST) procedures as well as memory reference code. The POST procedures and memory reference code perform various functions within the computer system before control of the computer system is turned over to the operating system. The computer system 400 further comprises a network interface card (NIC) 438 illustratively coupled to the PCI bus 432. The NIC 438 acts to couple the computer system 400 to a communication network, such the Internet, or local- or wide-area networks.

Still referring to FIG. 4, computer system 400 may further comprise a super input/output (I/O) controller 440 coupled to the bridge 428 by way of the LPC bus 430. The Super I/O controller 440 controls many computer system functions, for example interfacing with various input and output devices such as a keyboard 442, a pointing device 444 (e.g., mouse), a pointing device in the form of a game controller 446, various serial ports, floppy drives and disk drives. The super I/O controller 440 is often referred to as "super" because of the many I/O functions it performs.

The computer system 400 may further comprise a graphics processing unit (GPU) 450 coupled to the host bridge 414 by way of bus 452, such as a PCI Express (PCI-E) bus or Advanced Graphics Processing (AGP) bus. Other bus systems, including after-developed bus systems, may be equivalently used. Moreover, the graphics processing unit 450 may alternatively couple to the primary expansion bus 426, or one of the secondary expansion buses (e.g., PCI bus 432). The graphics processing unit 450 couples to a display device 454 which may comprise any suitable electronic display device upon which any image or text can be plotted and/or displayed. The graphics processing unit 450 may comprise an onboard processor 456, as well as onboard memory 458. The processor 456 may thus perform graphics processing, as commanded by the main processor 410. Moreover, the memory 458 may be significant, on the order of several hundred megabytes or more. Thus, once commanded by the main processor 410, the graphics processing unit 450 may perform significant calculations regarding graphics to be displayed on the display device, and ultimately display such graphics, without further input or assistance of the main processor 410.

In the specification and claims, certain components may be described in terms of algorithms and/or steps performed by a software application that may be provided on a non-transitory storage medium (i.e., other than a carrier wave or a signal propagating along a conductor). The various embodiments also relate to a system for performing various steps and operations as described herein. This system may be a specially-constructed device such as an electronic device, or it may include one or more general-purpose computers that can follow software instructions to perform the steps described herein. Multiple computers can be networked to perform such functions. Software instructions may be stored in any computer readable storage medium, such as for example, magnetic or optical disks, cards, memory, and the like.

References to "one embodiment", "an embodiment", "a particular embodiment" indicate that a particular element or characteristic is included in at least one embodiment of the invention. Although the phrases "in one embodiment", "an embodiment", and "a particular embodiment" may appear in various places, these do not necessarily refer to the same embodiment.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A non-transitory machine-readable storage medium comprising executable instructions that, when executed, cause one or more processors to:

model, using one or more models, safety barriers in one or more drilling rigs based on drilling rig safety barrier data;

identify, based on the one or more models, a first impending invalidation of a first safety barrier; and initialize, triggered solely by the instructions, a second safety barrier based on the impending invalidation.

2. The medium of claim 1, wherein the instructions cause the one or more processors to record, triggered by the impending invalidation, the drilling rig safety barrier data.

3. The medium of claim 1, wherein the instructions cause the one or more processors to test responsiveness of human input reacting to the impending invalidation.

4. The medium of claim 1, wherein the instructions cause the one or more processors to activate, triggered by a second impending invalidation of a second safety barrier, a failsafe procedure.

5. The medium of claim 1, wherein initialization of the second safety barrier is triggered without human input.

6. The medium of claim 1, wherein the instructions cause the one or more processors to activate, triggered by the one or more models indicating an unknown safety barrier status, a failsafe procedure.

7. The medium of claim 1, wherein the instructions cause the one or more processors to prevent removal of a safety barrier when two or fewer models indicate validated safety barriers.

8. The medium of claim 1, wherein at least one of the safety barriers is selected from the group consisting of: riser; casing; wellhead; surface equipment; blowout preventer; cementing; and mud column.

9. A system, comprising:

one or more processors;

memory coupled to the one or more processors, the memory storing executable instructions that when executed by the one or more processors, cause the one or more processors to:

model, using one or more models, safety barriers in one or more drilling rigs based on drilling rig safety barrier data;

identify, based on the one or more models, a first impending invalidation of a first safety barrier; and initialize, triggered solely by the instructions, a second safety barrier based on the impending invalidation.

10. The system of claim 9, wherein the instructions cause the one or more processors to record, triggered by the impending invalidation, the drilling rig safety barrier data.

11. The system of claim 9, wherein the instructions cause the one or more processors to test responsiveness of human input reacting to the impending invalidation.

12. The system of claim 9, wherein the instructions cause the one or more processors to activate, triggered by a second impending invalidation of a second safety barrier, a failsafe procedure.

13. The system of claim 12, wherein initialization of the second safety barrier is triggered without human input.

14. The system of claim 9, wherein the instructions cause the one or more processors to activate, triggered by the one or more models indicating an unknown safety barrier status, a failsafe procedure.

15. The system of claim 9, wherein the instructions cause the one or more processors to prevent removal of a safety barrier when two or fewer models indicate validated safety barriers.

16. The system of claim 9, wherein at least one of the safety barriers is selected from the group consisting of: riser; casing; wellhead; surface equipment; blowout preventer; cementing; and mud column.

17. A method, comprising:

modeling, using one or more models and one or more processors, safety barriers in one or more drilling rigs based on drilling rig safety barrier data;

identifying, based on the one or more models, an impending invalidation of a first safety barrier;

automatically, without human input, initializing a second safety barrier based on the impending invalidation; and outputting, using the one or more processors, to a display a status of at least one safety barrier indicated by at least one model.

18. The method of claim 17, further comprising testing responsiveness of human input reacting to the impending invalidation.

19. The method of claim 17, further comprising preventing removal of a safety barrier when two or fewer models indicate validated safety barriers.

20. The method of claim 17, wherein at least one of the safety barriers is selected from the group consisting of: riser; casing; wellhead; surface equipment; blowout preventer; cementing; and mud column.

* * * * *